US007930863B1

(12) United States Patent
Fyfe

(10) Patent No.: US 7,930,863 B1
(45) **Date of Patent: *Apr. 26, 2011**

(54) CONNECTOR FOR REINFORCING THE ATTACHMENT AMONG STRUCTURAL COMPONENTS

(75) Inventor: Edward R. Fyfe, Del Mar, CA (US)

(73) Assignee: Fyfe Co., L.L.C., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/583,100

(22) Filed: Aug. 15, 2009

Related U.S. Application Data

(60) Division of application No. 11/399,282, filed on Apr. 6, 2006, now Pat. No. 7,574,840, which is a continuation-in-part of application No. 10/205,294, filed on Jul. 24, 2002, now Pat. No. 7,207,149.

(51) Int. Cl.
*E04B 1/38* (2006.01)

(52) U.S. Cl. ..... 52/582.1; 52/223.13; 52/586.2; 52/585.1; 52/223.14; 52/712; 52/747.1; 52/741.1

(58) Field of Classification Search ..... 52/223.13, 52/223.14, 582.1–585.1, 707, 698, 700, 703, 52/706, 708, 712, 261, 271–272, 286, 256, 606, 607, 223.4, 596, 600; 403/169, 170, 172

See application file for complete search history.

(56) References Cited

U.S. PATENT DOCUMENTS

| | | | |
|---|---|---|---|
| 3,464,173 | A | 9/1969 | Ros |
| 3,738,071 | A | 6/1973 | Finsterwalder |
| 6,571,518 | B1 | 6/2003 | Barley |
| 6,647,678 | B1 | 11/2003 | Zambelli et al. |

*Primary Examiner* — Jeanette E. Chapman

(74) *Attorney, Agent, or Firm* — Palomar Patent; Mary Jo Redman; Calif Tervo

(57) ABSTRACT

Reinforcing connector (10) for reinforcing attachment among components (110) of a structure (100); such as crossing beams (111). Reinforcing connector (10) includes a length of roving (20) composed of filaments (25). Roving (20) is disposed in borehole (50) piercing first beam 111A Free ends (21,23) of roving (20) protrude from borehole openings (51) and are splayed apart into individual filaments (25). Filaments (25) are attached to surfaces of components (110) with adhesive means (30). Reinforcing connector (10) increases ductility and resistance to lateral forces of structure (100).

7 Claims, 1 Drawing Sheet

CONNECTOR FOR REINFORCING THE ATTACHMENT AMONG STRUCTURAL COMPONENTS

CROSS-REFERENCE TO RELATED APPLICATIONS

This application is a Division of application Ser. No. 11/399,282, filed Apr. 6, 2006, now U.S. Pat. No. 7,574,840 which is a Continuation-in-Part of application Ser. No. 10/205,294, filed Jul. 24, 2002, which issued on Apr. 24, 2007 as U.S. Pat. No. 7,207,149 B2.

FIELD OF THE INVENTION

This invention relates in general to reinforcing a structure, and more particularly to a connector for reinforcing the attachment among the components of a structure.

BACKGROUND OF THE INVENTION

Buildings have traditionally been designed to support their own weight plus that of expected inhabitants and furnishings. Buildings and other structures for supporting weight have long been expected to be very strong under vertical compression. Concrete is a favorite material for weight-bearing structures because it is inexpensive and has exceptional compressive strength.

In the mid-1900s, architects began to take lateral forces into account more than they had previously. Wind can exert strong lateral force on tall buildings and long bridges. Smaller structures were still designed without much regard for strong lateral forces until concern for earthquake resistance began growing in the 1970s in the United States, partly due to the massive Anchorage earthquake in 1964.

Many buildings are still in use that were not built to withstand strong lateral forces. There is a need for a means to reinforce old structures so that they resist strong lateral force, such as could be caused by earthquake, storm, or explosion. Some present techniques for reinforcing structures require encapsulation of the structure in steel rods or panels, sprayed-on concrete, or resin-impregnated fiber panels. Other techniques require extensive excavation next to the structure or addition of external buttresses. These present techniques have disadvantages and are not applicable to all situations.

New structures are often built of multiple prefabricated components, such as concrete beams, columns, or masonry blocks; combinations of prefabricated and poured-in-place components are also used. In the past, gravity and friction were frequently the main means of passive connection of components. For example, a structure consisting of a slab deck atop prefabricated columns will stay in position indefinitely, as long as the structure is only supporting its own weight and the weight of the people, vehicles, or other components that are on the slab.

To withstand lateral forces such as seismic or wind forces, however, a structure's components must be strongly connected together. Yet, it has been found that extremely rigid structures do not fare as well in earthquakes or wind as structures with some flexibility.

The connector of the present invention is an inexpensive and effective way to reinforce many types of structure. The present invention can be installed in a small area with minimal disruption of the functioning of an existing and occupied structure. The connector is also useful and cost-effective for reinforcing new structures.

The invention is an efficient way to reinforce masonry block walls and large structures that include slabs columns, and beams.

SUMMARY OF THE INVENTION

The present invention is a connector that reinforces the attachment between multiple structural components. A structure reinforced by connectors of the invention is less likely to fail under lateral forces, such as those experienced during an earthquake, hurricane, or explosion.

The connector includes a length of roving made of high-tensile-strength flexible filaments. Typically, the roving is connected to a first structural component by threading the roving through a borehole drilled through the component and backfilling the borehole with epoxy, polyurethane, or grout.

The two free ends of the roving extend out from the opposite ends of the borehole. Each end then has its individual filaments splayed apart and the filaments are attached to a surface of a second structural component with adhesive. Splaying apart the filaments spreads the force applied by the connector over a large surface area to prevent the connector from popping out a chunk of the second component when a force is experienced. Also, attaching the filaments over a large area typically increases the strength of the adhesive bond.

Using this connector, large prefabricated components can be "tied" together so as to resist forces from any direction. The connector increases the apparent ductility of the structure such that failure, if it occurs, is gradual instead of sudden and catastrophic.

The invention will now be described in more particular detail with respect to the accompanying drawings, in which like reference numerals refer to like parts throughout.

DETAILED DESCRIPTION OF THE INVENTION

Figure 1:
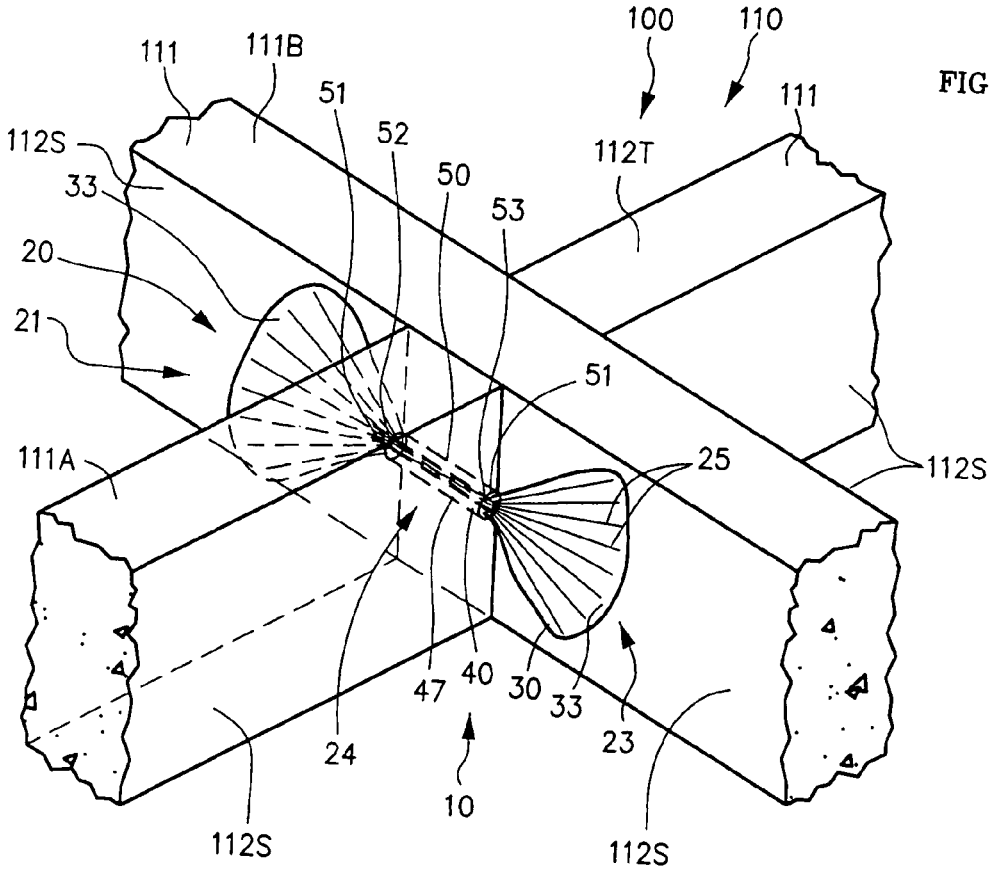
FIG. 1 is a perspective view, partly cut away, of the connector of the present invention reinforcing the connection of two perpendicular beams.

FIG. 1 is a perspective view, partly cut away, of the connector 10 of the present invention reinforcing the connection of two components 110, such as perpendicular beams 111, such as of a structure 100.

Connector 10 generally includes roving 20, borehole 50 piercing first beam 111A, backfill 40, and adhesive means 30.

Roving 20 is inserted into borehole 50 with free ends 21,23 protruding from borehole borehole openings 51. Middle portion 24 of roving 20 is disposed in borehole 50 between first borehole borehole opening 52 and second borehole opening 53. Backfill 40, such as epoxy resin 47, is added to borehole 50 to anchor roving 20 within borehole 50. Epoxy resin 47 fills borehole 50, embedding roving 20, and adheres to the inner surface of borehole 50. The two free ends 23 are splayed so that filaments 25 are substantially separate. Filaments 25 are attached to outer surfaces of second beam 111B, by adhesive means 30.

Borehole 50 is typically created by drilling, but other methods such as high-pressure water boring may also be used. The terms "drill" or "drilling" as used in this specification or in the claims should be read as including other methods of providing a borehole.

Borehole 50 is a hole or groove that allows passage of the length of roving from one surface of a structural component 110 to another surface, generally an opposite one. Borehole 50 may be completely surrounded by a single structural component 110 or borehole 50 may be mostly within a first component 110 but bordered by a second component 110. Alternatively, borehole 50 may be partially surrounded by a first component 110 and partially surrounded by a second component 110. Alternatively, borehole 50 may be a groove in a surface of a component 110, which is approximately as deep as the nominal diameter of roving 20 and is capable of retaining roving 20 and backfill material 40 until backfill material 40 is hardened enough to retain roving 20 against removal.

Roving 20 is typically a loosely twisted length of flexible filaments 25. Filaments 25 are generally the same length as roving 20; that is, roving 20 is not composed of short, fuzzy filaments that hold together by friction. Filaments 25 may be made of glass, graphite, nylon, aramid, carbon, high-modulus polyethylene, ceramic, quartz, PBO, fullerene, LCP, steel, or other material that can be manufactured in long filaments and that has high tensile strength.

Backfill 40 is preferably a solidifiable fluid that can be poured or injected into borehole 50 and that preferably hardens without addition of heat or evolution of toxic or obnoxious fumes. Backfill 40 can be a cementitious material, such as grout or a synthetic or natural curable resin, such as epoxy 47, polyurethane, acrylic, or other resin that has good cohesive and adhesive strength. The viscosity of backfill 40, when in the fluid state, is preferably low enough that backfill 40 flows around roving 20 to embed it intimately. Roving 20 may include an adhesion promoting coating on the surface of filaments 25 to increase the adhesion between roving 21 and backfill 40.

Filaments 25 of each free end 21, 23 are spread apart, such as by pulling and using the hands to apply shearing force generally perpendicular to the length of roving 20. The separated filaments 25 are splayed against an area of the surface of second beam 111B that is adjacent a borehole opening 51. The area of the surface of second beam 111B against which filaments 25 are splayed is typically at least three times as wide as the nominal diameter of roving 20; thus, the length of free ends 21, 23 protruding from a borehole opening 51 must be at least equal to the nominal diameter of roving 20 and is generally greater. By "nominal diameter" is meant the average diameter of roving 20, when roving 20 is neither compressed nor with filaments 25 splayed apart.

The splayed filaments 25 are attached to an area of the surface of second beam 111B by adhesive means 30, such as epoxy resin 33. Adhesive means 30 may be any of many synthetic or natural resins, such as polyurethane, polyurea, acrylic, latex, or silicone, that have high cohesive and adhesive strength and that adhere well to roving 20 and the surface of second beam 111B. Adhesive means 30 may also include an inorganic material, such as cementitious grout, or a composite, such as a panel of resin-impregnated fiberglass.

After backfill 40 and adhesive means 30 are hardened, motion of first beam 111A relative to second beam 111B will put tensile force on roving 20, which opposes and limits the motion. More than one connector 10 can be attached to a structure, if needed, to prevent movement in different directions. However, because filaments 25 are splayed over a relatively wide area of the surface of second beam 111B, connector 10 opposes a range of force vectors. This is an advantage of connector 10 over reinforcement methods with a single-point attachment, such as a cable or strap.

In a further advantage, the tensile force on adhesive means 30 is spread over a wide area, reducing the chance of failure. Reinforcement by a cable or strap may cause a cohesive failure within a component 110 such that a chunk of the component 110 could be pulled out by the cable or strap during an earthquake or other lateral force event.

Epoxy backfill resin 47 and epoxy adhesive 33 are synthetic resins that adhere well to many construction materials and have good cohesive strength. Other synthetic and natural resins with these qualities may also be used, including but not limited to polyurethane, acrylic, and silicone. Inert filler material may be included in epoxy backfill resin 47 or epoxy adhesive 33, or both, in order to make the thermal expansion characteristics of backfill resin 47 and epoxy adhesive 33 more similar to those of components 110.

It is preferred that adhesive means 30, roving 20, and backfill material 40 be water resistant and able to retain their strength over long periods of time, even when exposed to thermal cycling, including that due to seasonal and diurnal variation. It is preferred, in some cases, that adhesive means 30, roving 20, and backfill material 40 include additive or coating, not shown, to render the materials more resistant to ultraviolet radiation and fire.

Although roving 20 is preferably composed of high strength filaments 25, it is foreseen that roving 20 may break under great stress. It is generally preferred that connector 10 should fail in a ductile, gradual manner, rather than in a brittle, sudden manner. For this reason, roving 20 may be composed of more than one type of filament 24. For example, glass filaments 25 may be intermixed with graphite filaments 25; or graphite filaments of different diameters may be mixed within roving 20. The filaments 25 with lower ductility will break first, then the filaments 25 with greater ductility will stretch, and finally the stretched filaments 25 of greater ductility will snap. This preferred behavior is known as ductile performance.

When a structure breaks in a gradual, ductile manner, it may be possible to notice that failure is impending and do corrective repairs. Even if failure is rapid enough that repair is not possible, there may be sufficient time to at least evacuate the structure safely.

If all filaments 25 were of equal strength and ductility, the breakage of a few filaments 25 could cascade rapidly into sudden breakage of all filaments 25, possibly followed by catastrophic collapse of the structure. This non-preferred behavior is known as brittle performance.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A reinforcing connector for reinforcing the attachment among multiple components of a structure including at least a first component and a second component, each component including exterior surfaces and an interior volume, a borehole piercing the volume of the first component from one surface of the first component to another surface of the first component and having an borehole opening at each opposite end of the borehole, said reinforcing connector including:

a length of roving, comprising a bundle of flexible filaments and including:

two free ends, and a middle portion between said two free ends; said middle portion disposed in the borehole of the first component and each said free end protruding from an opposite borehole opening of the borehole; and adhesive attaching said free ends to exterior surfaces of the components; at least one said free end being attached to the second component.

2. The reinforcing connector of claim 1, wherein: both said free ends are attached to the second component.

3. The reinforcing connector of claim 1, wherein said roving has a nominal width and comprises a bundle of filaments capable of being separated and splayed apart; and wherein each said free end comprises said filaments splayed apart and attached by adhesive to an area of the surface of the component; the area being at least three times wider than the nominal width of said roving.

4. The reinforcing connector of claim 1, said roving comprising: a bundle of filaments comprising:

filaments of a first material having a first ductility; and filaments of a second material having a second ductility different from said first ductility; such that said length of roving would break gradually if stressed beyond its strength.

5. The reinforcing connector of claim 1, said roving comprising:

a bundle of filaments; including filaments of at least one of the materials of the group: glass, graphite, nylon, aramid, carbon, high-modulus polyethylene, ceramic, quartz, PBO, fullerene, or LCP.

6. A connector for strengthening the attachment between intersecting beams, a first beam having a borehole piercing it, said connector comprising:

a length of roving, comprising a bundle of flexible filaments and including:

two free ends, and a middle portion between said two free ends; said middle portion disposed in the borehole of the first beam and each said free end protruding from an opposite borehole opening of the borehole;

and adhesive attaching said free ends to exterior surfaces of the beams; at least one said free end being attached to a second beam.

7. The reinforcing connector of claims 1, further including:

backfill material filling said borehole and surrounding said roving such that said roving is anchored against removal from said borehole.

* * * * *